United States Patent [19]

Asai et al.

[11] Patent Number: 5,054,308

[45] Date of Patent: Oct. 8, 1991

[54] FORGING PUNCH

[75] Inventors: Tomohito Asai, Gifu; Toru Isono, Kagamigahara, both of Japan

[73] Assignee: Toyoda Gosei Co., Ltd., Nishikasugai, Japan

[21] Appl. No.: 568,866

[22] Filed: Aug. 17, 1990

[30] Foreign Application Priority Data

Aug. 21, 1989 [JP] Japan ..... 1-214635

[51] Int. Cl.[5] ..... B21D 37/18

[52] U.S. Cl. ..... 72/463; 72/273; 72/44

[58] Field of Search ..... 72/273, 354.6, 44, 354.8, 72/463

[56] References Cited

U.S. PATENT DOCUMENTS 4,068,518 1/1978 Dockerill ..... 72/354.8

FOREIGN PATENT DOCUMENTS 0259851 11/1986 Japan ..... 72/354.6

62-45011 9/1987 Japan .

*Primary Examiner*—Lowell A. Larson

*Assistant Examiner*—M. J. McKeon

*Attorney, Agent, or Firm*—Cushman, Darby & Cushman

[57] ABSTRACT

A forging punch of the present invention includes: an outer punch of a cylindrical shape; and an inner punch disposed in the outer punch and protruding from an end surface of the outer punch; at least one of the punches having at least one groove for relieving oil formed either on an inner peripheral surface of the outer punch or on an outer peripheral surface of the inner punch. Therefore, an oil remaining between the end surface of the outer punch and the bottom surface of a workpiece is relieved to the outside of the forging punch by way of the groove, thereby enabling precise forging. Further, the forging punch has obviated additional processing, because no traces of the groove are marked on the workpiece after processing.

8 Claims, 3 Drawing Sheets

FORGING PUNCH

BACKGROUND OF THE INVENTION

1. Field of the Invention

The present invention relates to a punch which is employed when forming a two-stage hole configuration, comprising a first stage hole of a given diameter and a second stage hole of a smaller diameter than the diameter of the first stage hole, by forging.

2. Description of the Prior Art

A hose fitting has been formed by cold forging recently. For instance, such a technology is disclosed in Japanese Examined Patent Publication (KOKOKU) No. 45011/1987 and so on.

When forming a hose fitting, a workpiece having a hole portion 100 as illustrated in FIG. 4 is prepared first. Then, a first stage hole is formed, and a second stage hole is formed by using a predetermined punch at the same time. The workpiece is thus made into a configuration as illustrated in FIG. 5. In FIG. 5, a first hole 101 being the first stage hole and having a larger diameter is used as an engagement portion to be engaged with the other mating part after a female thread and the like is formed thereon, and a second hole 102 being the second stage hole, having a smaller diameter and disposed at the bottom portion of the first hole 101 is used as a joint portion to be joined with a nipple, for example, after a through hole is made at the bottom portion.

When processing such a two-stage hole configuration by forging, a punch 200 as illustrated in FIG. 6 has been employed, for instance. The punch 200 comprises a larger diameter portion 201 having the outside diameter corresponding to the diameter of the first hole 101 having a larger diameter, and a smaller diameter portion 202 having the outside diameter corresponding to the diameter of the second hole 102 having a smaller diameter. However, when the end surface of the larger diameter portion 201 is made into a flat surface perpendicular to the axial direction of the punch 200, an oil supplied during the forging is enclosed between the end surface of the larger diameter portion 201 and the workpiece. The enclosed oil makes it hard to precisely carry out the forging.

Accordingly, a punch 300 as illustrated in FIG. 7 has been employed in the forging operation so far. The punch 300 also comprises a larger diameter portion 301 and a smaller diameter portion 302, but the end surface of the larger diameter portion 301 is made into an inclined tapered surface 303. Further, the larger diameter portion 301 has a chamfered portion 304 disposed on the cylindrical surface thereof and extending in the axial direction thereof. An oil remaining between the punch 300 and a workpiece is expelled from the tapered surface 303 to the outside of the workpiece by way of the chamfered portion 304.

However, when processing a such hole by forging employing the above-mentioned punch 300 as illustrated in FIG. 7, the hole portion thus formed comes to have a configuration as illustrated in FIG. 8. Namely, the bottom surface of the first hole 101 cannot be made into a flat surface perpendicular to the axial direction of the workpiece, it is rather made into an inclined tapered surface 103. Further, there is a marking problem. That is, traces 104 resulting from the chamfered portion 304 of the larger diameter portion 301 of the punch 300 are marked on the inner periphery surface of the first hole 101. Consequently, an additional processing such as machining and the like has been further required even after the hole processing has been completed by forging.

SUMMARY OF THE INVENTION

The present invention has been developed in view of the above-mentioned problems associating with the prior art. It is therefore a primary object of the present invention to improve a configuration of a forging punch, thereby getting rid of the additional processing after forging.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIGS. 1 through 3 illustrate a forging punch of a preferred embodiment according to the present invention, wherein:

FIG. 1 is a front view of the forging punch, and the half of the view is illustrated in section;

FIG. 2 is a cross sectional view taken along the line A—A in FIG. 1; and FIG. 3 is an explanatory cross sectional view illustrating a processing operation, in which a two-stage hole is processed onto a workpiece with the forging punch;

DETAILED DESCRIPTION OF THE INVENTION

Figure 1:
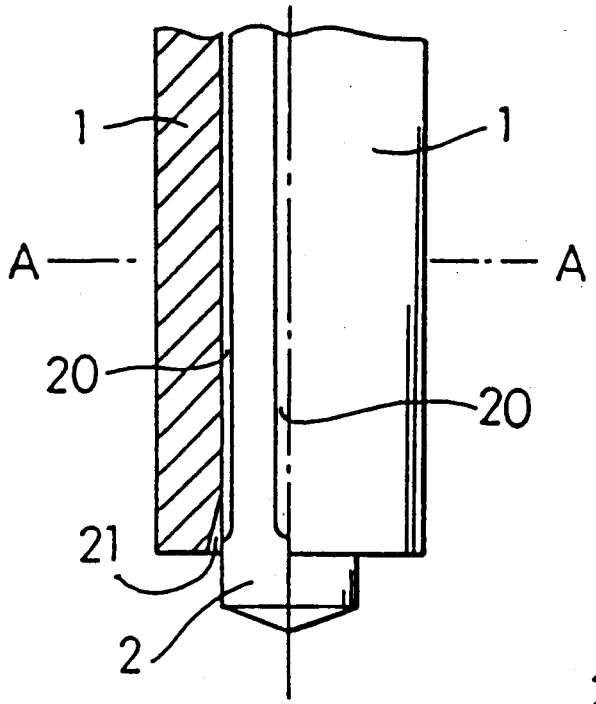

The above and other objects can be carried out by a forging punch according to the present invention. The forging punch is for processing a first hole of a given diameter and a second hole of a diameter smaller than that of the first hole formed concentrically at the bottom of the first hole, and comprises: an outer punch of a cylindrical shape extending in an axial direction for forming the first hole, the outer punch having a central hole extending in the axial direction; and an inner punch disposed in the central hole and protruding from an end surface of the outer punch for forming the second hole; at least one of the punches having at least one groove for relieving oil extendng adjacent the central hole in the axial direction formed on at least one of an inner peripheral surface of the outer punch and an outer peripheral surface of the inner punch.

Major features of the forging punch according to the present invention are that the forging punch is made into a duplex arrangement having the outer punch and the inner punch, and that the groove for relieving an oil is formed on at least one of the outer punch and the inner punch. The groove has an opening at the end surface of the outer punch, and extends adjacent the central hole of the outer punch in the axial direction, whereby the oil which remains between the end surface of outer punch and the workpiece during forging can be expelled to the outside of the forging punch. As a result, the forging can be carried out precisely. In addition, in the case that the outer punch and the inner punch are so arranged that they are made relatively movable with respect to each other in the axial direction, the depth of the second hole can be varied easily. Consequently, the degree of freedom on the processed configurations has been increased.

As for the position for forming the groove, it may be formed either on the inner peripheral surface of the outer punch or on the outer peripheral surface of the inner punch. It is preferable to form the groove on the outer peripheral surface of the inner punch because it is easier to process such a groove thereon. Further, the number of the grooves is not specified particularly, namely the forging punch may be provided with a plurality of the grooves. Furthermore, the forging punch according to the present invention is not only applicable to cold forging but also to hot forging.

The forging punch according to the present invention operates as follows: The first hole is formed with the outer punch by forging, and the second hole whose diameter is smaller than that of the first hole is formed with the inner punch by forging. In the operation, an oil is usually supplied while the first hole and the second hole are formed by forging. During the forging, the oil remaining in the first hole is relieved to the outside of the forging punch by way of the groove as the forging punch advances. Accordingly, the oil is prevented from being enclosed between the outer punch and the bottom portion of the first hole, thereby enabling a precise processing.

Since no tapered surface is provided at the end of the outer punch as it is provided at the end of the conventional forging punches, the end surface of the outer punch may be made into a flat surface perpendicular to the axial direction thereof, and a large degree of freedom is available for the configuration of the first hole. In addition, since the groove extends between the outer punch and the inner punch in the axial direction, no marking problem occurs, namely no trace of the groove is marked on the processed surface of the workpiece. Therefore, it is possible to reduce the man-hour requirement for the additional processing after forging and accordingly to reduce the overall manufacturing cost.

When the outer punch and the inner punch are made movable relatively with respect to each other in the axial direction thereof, it is possible to adjust the projection allowance of the end of the inner punch with ease. Hence, it is easy to adjust the dimensions of the forging punch in accordance with the depth ratio of the first hole depth to the second hole depth.

It has been known that the strength of the punch should be made greater as the diameter of the hole to be processed becomes smaller. Hence, the whole punch has been made of a material having a strength suitable for processing the second hole in the conventional punches. Accordingly, the part of punch for processing the first hole has been made of a material of an excessive quality. According to the forging punch of the present invention, however, only the inner punch may be made of a material having a greater strength such as cemented carbide, and the outer punch may be made of a material having an ordinary strength such as high speed steel. Thus, it is possible to reduce the total cost of the forging punch.

DETAILED DESCRIPTION OF THE PREFERRED EMBODIMENT OF THE INVENTION

Having generally described the present invention, a further understanding can be obtained by reference to a certain specific preferred embodiment which is provided herein for purposes of illustration only and is not intended to be limiting unless otherwise specified.

Figure 2:
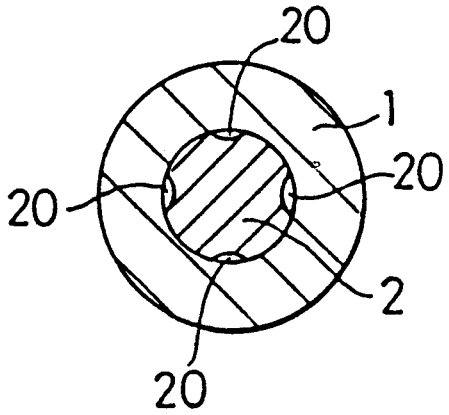
Figure 3:
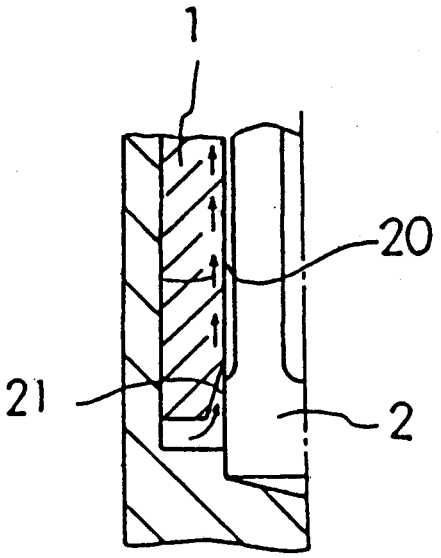
Figure 9:
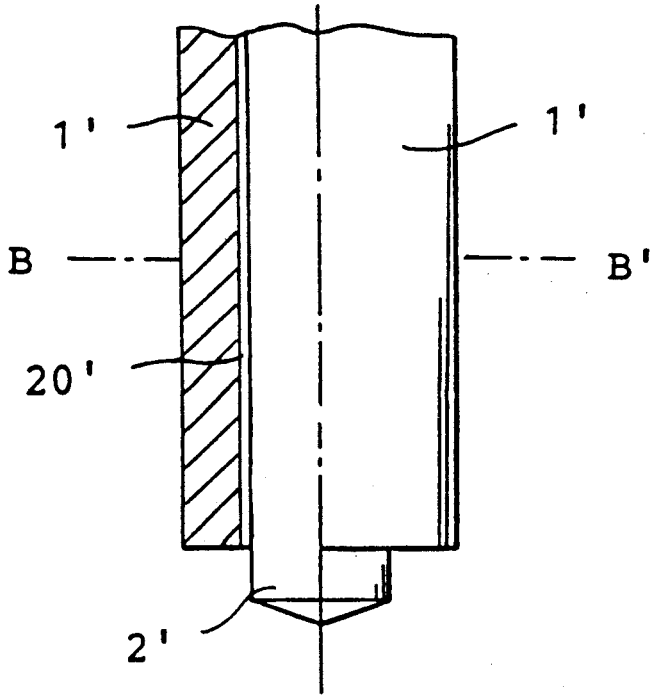
FIG. 9 is a partial cross sectional view of a forging punch of another preferred embodiment according to the present invention.
Figure 10:
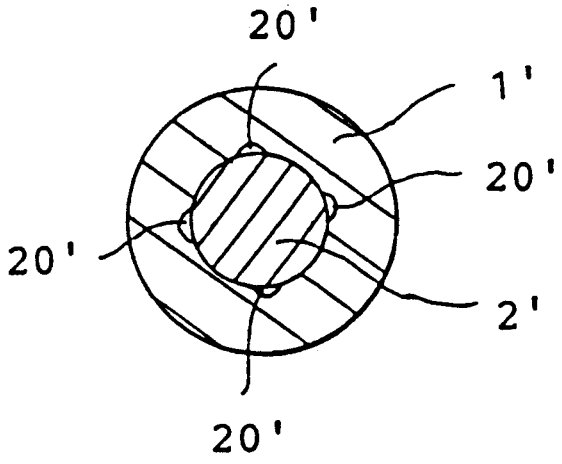
FIG. 10 is a cross sectional view taken along the line B—B in FIG. 9.

A forging punch of a preferred embodiment according to the present invention will be hereinafter described with reference to FIGS. 1 through 5. FIGS. 1 and 2 illustrate the forging punch of the preferred embodiment according to the present invention. The forging punch comprises an outer punch 1 of a cylindrical shape and an inner punch 2 disposed in a central hole of the outer punch 1. The outer punch 1 is made of high speed steel, and the inner punch 2 is made of cemented carbide. Four (4) grooves 20 extends to positions slightly backward from the end of the inner punch 2 on the outer peripheral surface thereof, and thus the grooves 20 do not come into contact with a second stage hole when the forming of a second stage hole is completed. Further, a cut-off portion 21 is formed in a partially tapered shape at the opening of the outer punch 1 on the end surface thereof, and is communicated with one end of the grooves 20. Furthermore, the other end of the grooves 20 is communicated with the outside of the outer punch 1. Moreover, the grooves 20 may extend down to the end of the inner punch 2 in the case that markings are permitted to appear on the inner peripheral surface of a second stage hole. If such is not the case, the grooves 20 are formed as illustrated in FIG. 3. In addition, as illustrated in FIGS. 9 and 10, a forging punch according to the present invention may have grooves 20' formed on an inner peripheral surface of an outer punch 1'.

Figure 4:
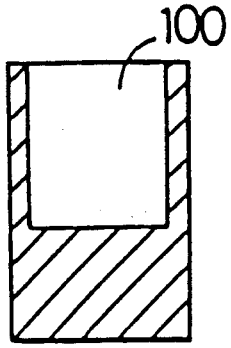
FIG. 4 is a cross sectional view illustrating a configuration of the workpiece prior to the processing operation.
Figure 5:
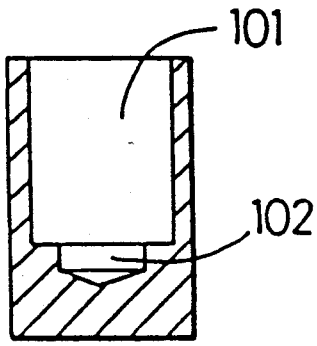
FIG. 5 is a cross sectional view illustrating a configuration of the workpiece after the processing operation.
Figure 6:
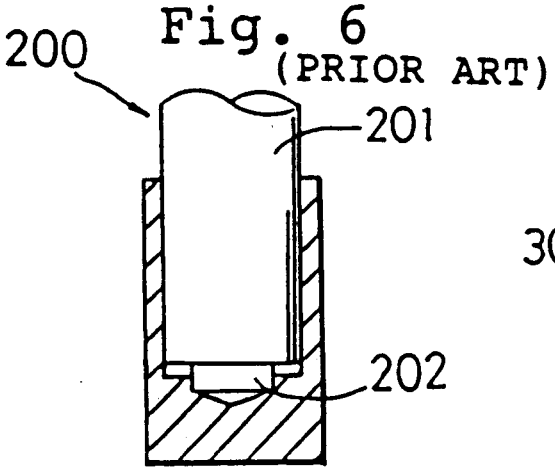
Fig. 6 (PRIOR ART)
FIG. 6 is an explanatory cross sectional view illustrating a processing operation, in which a two-stage hole is processed onto a workpiece with a conventional forging punch.
Figure 7:
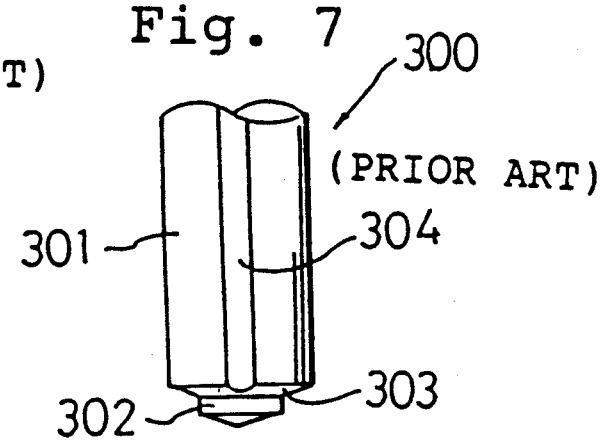
Fig. 7 (PRIOR ART)
FIG. 7 is a front view of another conventional forging punch.
Figure 8:
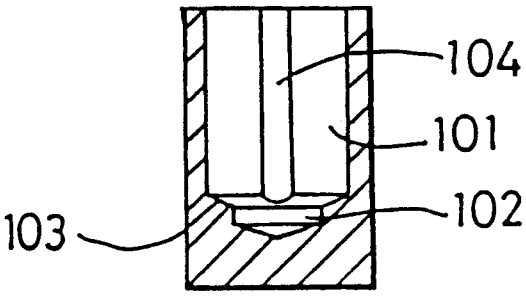
Fig. 8 (PRIOR ART)
FIG. 8 is a cross sectional view of a workpiece having a two-stage hole portion processed with the other conventional forging punch.

A forging process employing the thus arranged forging punch of the preferred embodiment will be hereinafter described, in which a workpiece as illustrated in FIG. 4 is formed into a configuration having a two-stage hole portion as illustrated in FIG. 5. First, the forging punch comprising the outer punch 1 and the inner punch 2 is press-fitted into a hole portion 100 of the workpiece. Accordingly, the inner punch 2 processes a second hole 102 at the bottom of the hole portion 100, and at the same time the outer punch 1 approaches the bottom of the hole portion 100 while processing a first hole 101. During the processing of the first hole 101 and the second hole 102, an oil remaining between the leading end surface of the outer punch 1 and the bottom portion of the first hole 101 is evacuated to the outside of the forging punch by way of the cut-off portion 21 and the grooves 20 as illustrated in FIG. 3. As a result, the oil is prevented from being enclosed between the end surface of the outer punch 1 and the workpiece, thereby enabling a precise processing.

Further, even when the end surface of the outer punch 1 is made into a flat surface perpendicular to the axial direction thereof, the remaining oil can be evacuated to the outside of the forging punch. Thus, it is unnecessary to make the end surface of the outer punch 1 into a tapered shape as in the conventional forging punch. Accordingly, the bottom surface of the first hole 101 can be made into a desired shape only by forging. Moreover, there arises no marking problem after processing the workpiece. Namely, no traces of the grooves 20 are marked on the workpiece, because the grooves 20 extend between the outer punch 1 and the inner punch 2 in the axial direction, and because no grooves 20 are exposed on the outer surface of the outer punch 1. Therefore, no additional processing such as machining and the like is required after the forging operation, and the man-hour requirement and the manufacturing cost can be reduced accordingly.

In addition, since the protruding length of the inner punch 2 from the end surface of the outer punch 1 can be adjusted freely, it is possible to flexibly follow any change on the hole configuration to be processed.

Finally, it has been necessary so far to make the whole of the forging punch out of expensive cemented carbide. In the forging punch of the preferred embodiment, however, only the inner punch 2 can be made of cemented carbide, and the outer punch 1 can be made of less expensive high speed steel. Therefore, the material cost of the forging punch can be reduced, and at the same time the performance of the forging punch can be improved.

Having now fully described the present invention, it will be apparent to one of ordinary skill in the art that many changes and modifications can be made thereto without departing from the spirit or scope of the present invention as set forth herein.

What is claimed is:

1. A forging punch for processing a first hole of a given diameter and a second hole of a diameter smaller than that of said first hole formed concentrically at the bottom of said first hole, said forging punch comprising:

an outer punch of a cylindrical shape extending in an axial direction for forming said first hole, said outer punch having a central hole extending in said axial direction; and an inner punch disposed in said central hole and protruding from an end surface of said outer punch for forming said second hole;

at least one of said punches having at least one groove for relieving oil extending adjacent said central hole in said axial direction formed on at least one of an inner peripheral surface of said outer punch and an outer peripheral surface of said inner punch wherein at least one of said grooves extends to an end surface of said outer punch.

2. The forging punch according to claim 1, wherein said outer punch and said inner punch are relatively movable with respect to each other in said axial direction.

3. The forging punch according to claim 1, wherein said groove is formed on an outer peripheral surface of said inner punch, and said outer punch has an opening communicating with said groove at an end surface.

4. The forging punch according to claim 3, wherein said groove extends to a portion of said inner punch, said portion is disposed adjacent to a top end of said second hole when forming of said second hole is completed.

5. The forging punch according to claim 1, wherein said forging punch has a plurality of said grooves.

6. The forging punch according to claim 1, wherein said outer punch and said inner punch are made of different materials.

7. The forging punch according to claim 6, wherein said outer punch is made of high speed steel and said inner punch is made of cemented carbide.

8. The forging punch according to claim 1, wherein said groove is formed on an inner peripheral surface of said outer punch, and has an opening at said end surface of said outer punch.

* * * * *